United States Patent [19]

Goodrich

[11] 4,249,280

[45] Feb. 10, 1981

[54] VACUUM CLEANER BAG ATTACHMENT

[75] Inventor: Gordon W. Goodrich, Grand Rapids, Mich.

[73] Assignee: Oreck Corp., New Orleans, La.

[21] Appl. No.: 40,512

[22] Filed: May 21, 1979

[51] Int. Cl.[3] ..... A47L 9/00

[52] U.S. Cl. ..... 15/323; 15/339; 15/410

[58] Field of Search ..... 15/323, 339, 350, 351, 15/410, 310, 328

[56] References Cited

U.S. PATENT DOCUMENTS

| | | | |
|---|---|---|---|
| 1,832,457 | 11/1931 | Gilbert | 15/323 |
| 2,219,911 | 10/1940 | Wells | 15/351 X |
| 3,636,584 | 1/1972 | MacFarland | 15/339 |
| 3,872,538 | 3/1975 | Crouser | 15/323 |

*Primary Examiner*—Christopher K. Moore
*Attorney, Agent, or Firm*—Andrus, Sceales, Starke & Sawall

[57] ABSTRACT

A pocket is formed on the lower exterior portion of a vacuum cleaner bag, with the pocket having a lip at its upper end which extends substantially across the entire bag width. The pocket functions to receive and store debris manually removed from the floor for later disposal. A removable caddy is provided for holding other desired equipment. The caddy includes a pair of expandable pockets and a rear flap which extends downwardly over the aforementioned lip and into the bag pocket. The caddy hangs freely from the lip and is held in position by the vertically extending vacuum cleaner handle.

7 Claims, 5 Drawing Figures

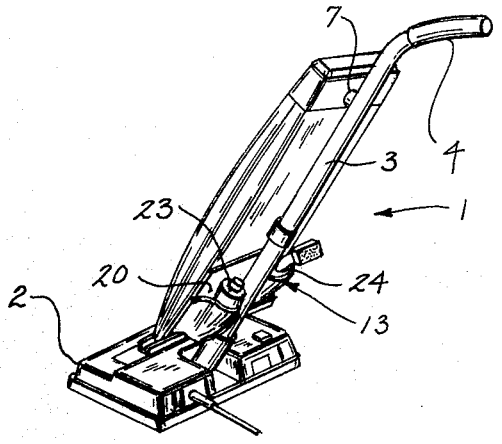
Fig. 1
Fig. 2
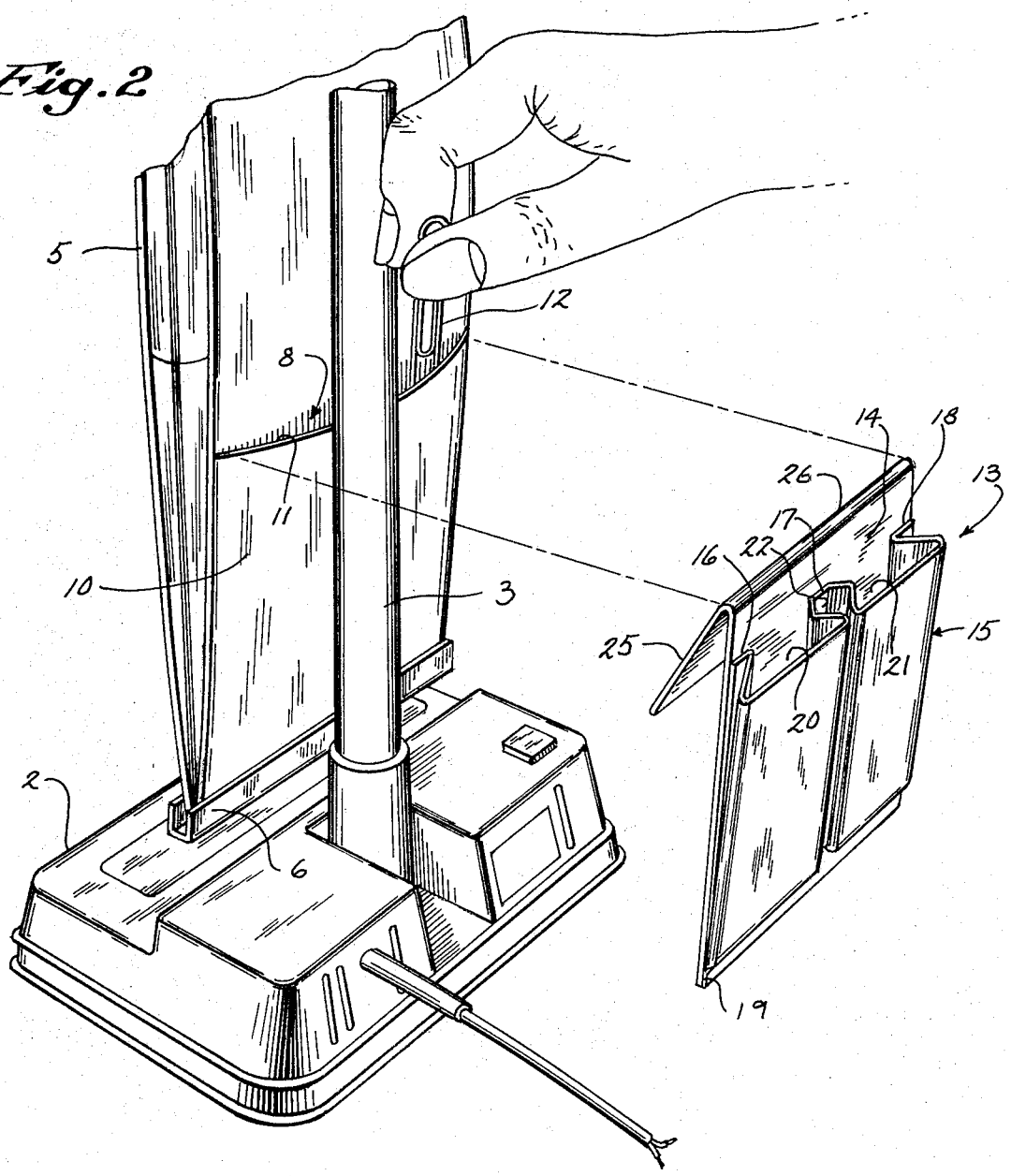

VACUUM CLEANER BAG ATTACHMENT

BACKGROUND AND SUMMARY OF THE INVENTION

This invention relates to vacuum cleaners generally, and more specifically to such cleaners which have flexible bags for containing dirt and debris picked up by the vacuum apparatus from the floor.

During the performance of floor cleaning duties, the operator may discover relatively large items on the floor which may be considered undesirable for pickup by the cleaner mechanism itself. It is desirable to manually pick such items up and accumulate them for subsequent disposal.

In addition, and during the vacuum cleaning operation, stains or spots may be observed on a carpet which, of course, should be removed promptly.

The present invention is directed to the concept of assisting the cleaner operator by making quickly available a container for placement of debris which has been manually removed from the floor, as well as a device for holding other readily needed equipment such as aerosol cans of spot cleaner.

In accordance with one aspect of the invention, a pocket is formed on the lower exterior portion of the vacuum cleaner bag facing the operator and machine handle, with the pocket having a lip at its upper end which extends substantially across the entire bag width. The pocket functions to receive and store debris manually removed from the floor for later disposal.

In accordance with another aspect of the invention, a removable caddy is provided for holding other desired equipment. The caddy includes a pair of expandable pockets and a rear flap which extends downwardly over the aforementioned lip and into the bag pocket. The caddy hangs freely from the said lip and is held in position by the vertically extending vacuum cleaner handle.

BRIEF DESCRIPTION OF THE DRAWINGS

The accompanying drawings illustrate the best mode presently contemplated by the inventor for carrying out the invention.

In the drawings:

FIG. 1 is a perspective view of a vacuum cleaner having the concepts of the invention incorporated therein;

FIG. 2 is an enlarged perspective view of the lower portion of the vacuum cleaner showing the bag pocket, with the caddy removed therefrom;

DESCRIPTION OF THE PREFERRED EMBODIMENT

Figure 3:
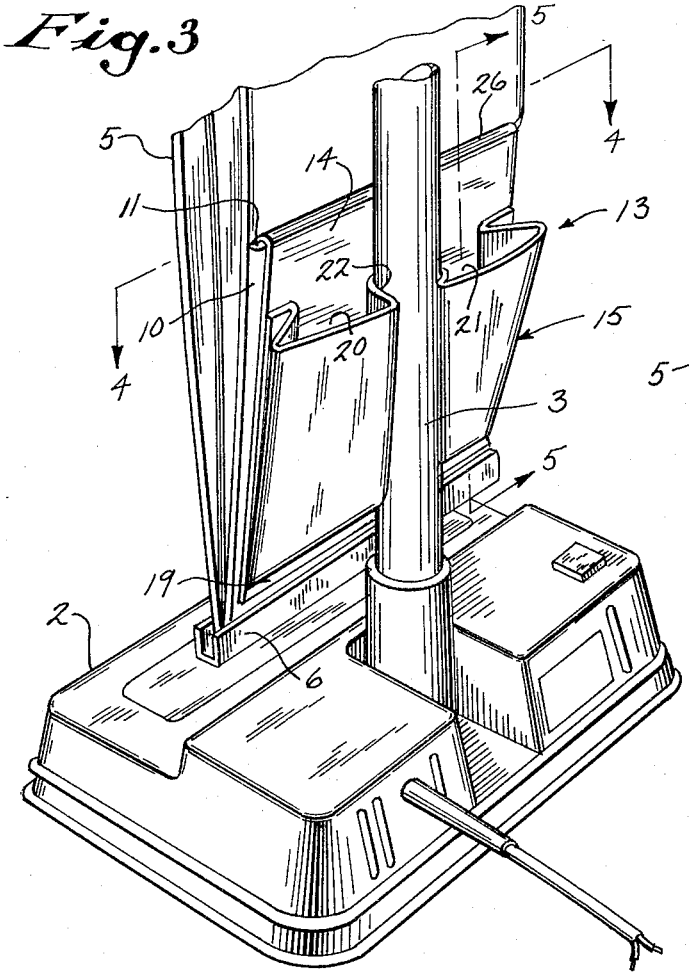
FIG. 3 is a view similar to FIG. 2 and with the caddy in position on the bag.

As shown in FIG. 1, the concepts of the invention are embodied in a vacuum cleaner 1 having a base 2 containing the usual motor and drive mechanism, not shown. An elongated vertical handle 3 is pivotally connected at its lower end to base 2 and is adapted to be grasped at its upper end 4 by the operator for reciprocably translating the cleaner over the floor in the usual manner. An expandable vacuum cleaner bag 5 is fixedly secured at its lower end to base 2 in any suitable way, such as by a U-shaped channel member 6. The upper portion of bag 5 is connected to handle 3, as through a tube 7 which forms part of a passageway for dirt and debris which extends from base 2 and upwardly through the handle itself. The bag-to-handle connection is such that bag 5 follows handle 3 as the latter is pivoted on base 2. Thus, bag 5 pivots relative to channel 6 when handle 3 pivots on the base.

In accordance with one aspect of the invention, means are provided on the side of bag 5 facing the operator for receipt and storage of debris which has been manually removed from the floor and which should not be picked up by the cleaner mechanism. For this purpose, and as best shown in FIG. 2, a pocket 8 is disposed on the rear face of bag 5 and closely adjacent the lower end thereof. Pocket 8 may be formed as an integral part of the bag, or may be mounted thereon, as by sewing. The pocket includes an inner wall 9 which is part of the bag, an outer wall 10, and a horizontal lip 11 at the upper end thereof, with lip 11 extending substantially across the entire bag width to form the pocket mouth into which may be dropped debris such as paper clips 12 or the like.

In accordance with another aspect of the invention, means are provided in association with pocket 8 to hold miscellaneous cleaning supplies and the like. For this purpose, a flexible removable caddy 13 is adapted to be mounted to bag 5. As best shown in FIG. 2, caddy 13 comprises a generally flat inner wall 14 to which is secured an outer member 15 formed by a plurality of spaced vertical seam attachments 16, 17 and 18 and a horizontal lower seam attachment 19 into a pair of pockets 20 and 21. The pockets are expandable and are separated by a vertical midportion of member 15 which forms an expandable channel 22.

Figure 5:
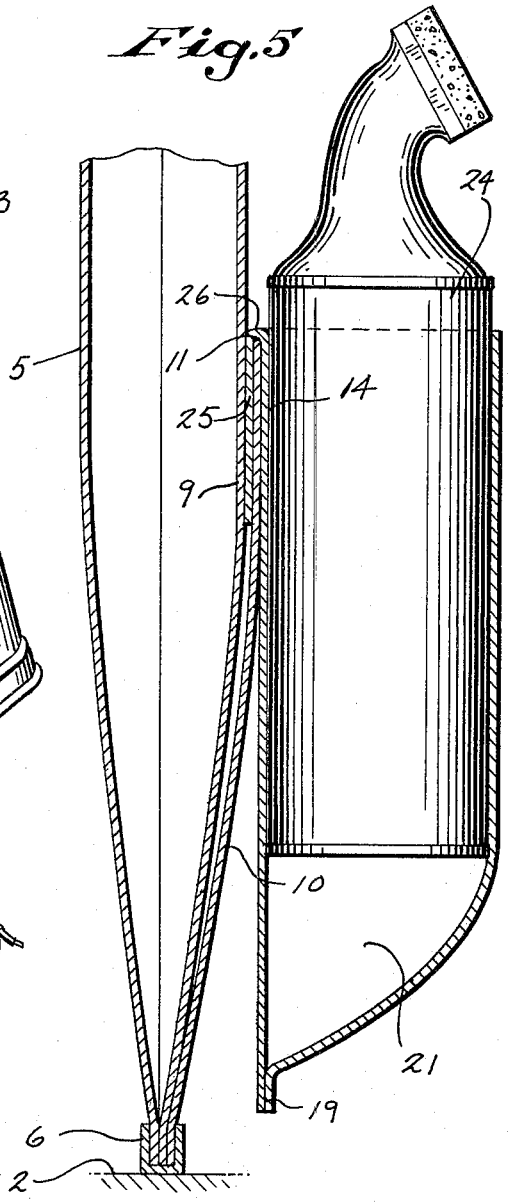
FIG. 5 is a vertical longitudinal section taken on line 5—5 of FIG. 3.
Figure 4:
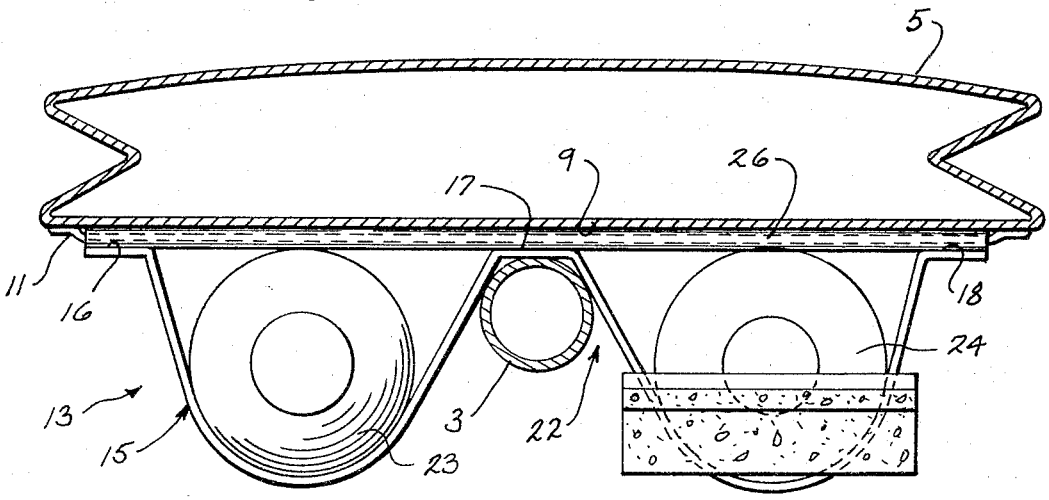
FIG. 4 is a horizontal transverse section taken on line 4—4 of FIG. 3 with cleaning supplies disposed in the caddy pockets.

As shown in FIGS. 1, 4 and 5, pockets 20 and 21 are adapted to receive cleaning equipment such as aerosol cans 23 and 24 of rug spot cleaners or the like.

Caddy 13 is adapted to be freely suspended from bag pocket 8 so that cans 23 and 24 are on the operator's side of bag 5 and thus readily available. For this purpose, a flap 25 is formed along the top edge 26 of inner wall 14 and with flap 25 being bent downwardly and rearwardly for insertion into bag pocket 8. Compare FIGS. 2 and 3. Caddy 13 thus hangs from bag pocket lip 11, with cans 23 and 24 disposed exteriorly of bag 5.

Equipment placed in caddy pockets 20 and 21 may at times be heavy. Under such circumstances, the caddy suspension arrangement may not be adequate to prevent flap 25 from slipping out of pocket 5, especially when caddy 13 is of soft material, such as cloth or the like.

The concept of the invention contemplates the utilization of means disposed exteriorly of caddy 13 to support it in its freely suspended position. For this purpose, caddy channel 22 is positioned to receive the lower portion of the vertically extending vacuum cleaner handle 3. Caddy 13 is thus confined between handle 3 and bag 5, and will remain so even during operation of the cleaner, due to the aforementioned co-pivoting relationship of the bag and handle.

The caddy support provided by handle 3 functions when bag 5 is contracted during non-use of the cleaner, and also when the bag is expanded during the floor vacuuming operation. In the latter case, caddy 13 is confined more tightly due to the increased biasing pressure of the expanded bag toward the rigid handle. This increases the efficiency of the support just when it is needed most, that is, when the caddy and its contents are subjected to vibrations and other forces which might tend to dislodge the caddy from pocket 8 during translation of the cleaner over the floor.

By positioning pocket 8 and caddy 13 on the lower portion of bag 5 facing the operator, the most efficient and time saving use of the device is provided.

Various modes of carrying out the invention are contemplated as being within the scope of the following claims particularly pointing out and distinctly claiming the subject matter which is regarded as the invention.

I claim:

1. In a vacuum floor cleaner:

(a) a base, (b) an elongated rigid handle pivotally mounted to said base and extending generally vertically upwardly therefrom, (c) a flexible expandable bag for receiving dirt and debris from the floor, said bag being connected between said base and said handle and copivotable with the latter, (d) storage means disposed on the handle side of said bag for receiving and storing debris manually removed from the floor by the operator, (e) and removable means supported by said storage means and supportingly confined between said bag and said handle for receiving cleaning supplies.

2. In a vacuum floor cleaner:

(a) a base, (b) an elongated rigid handle pivotally mounted to said base and extending generally vertically upwardly therefrom, (c) a flexible expandable bag for receiving dirt and debris from the floor, said bag being connected between said base and said handle and co-pivotable with the latter, (d) a removable caddy disposed on the handle side of said bag and extending across the width of the bag, (e) and means for freely suspending said caddy from said bag, (f) said caddy being supportingly confined between said bag and said handle, (g) said caddy including a pair of spaced pockets forming a channel therebetween, (h) and said channel being adapted to receive said handle therein to provide the said confinement of said caddy between said bag and said handle.

3. The vacuum cleaner of claim 2 wherein said bag, when expanded, comprises means to biasingly press said caddy toward said handle.

4. In a vacuum floor cleaner:

(a) a base, (b) an elongated rigid handle pivotally mounted to said base and extending generally vertically upwardly therefrom, (c) a flexible expandable bag for receiving dirt and debris from the floor, said bag being connected between said base and said handle and copivotable with the latter, (d) storage means disposed on the handle side of said bag for receiving and storing debris manually removed from the floor by the operator, (e) said storage means comprising a bag pocket disposed on the rear face of said bag, said pocket including a horizontal lip extending across the width of the bag, (f) and removable means supported by said storage means and supportingly confined between said bag and said handle for receiving cleaning supplies.

5. The vacuum cleaner of claim 4 wherein:

(a) said removable means comprises a caddy having a pair of spaced expandable pockets, (b) and said caddy has an inwardly and downwardly extending flap for extending into said bag pocket so that said caddy is freely suspended from said lip.

6. The vacuum cleaner of claim 5 wherein:

(a) said pair of caddy pockets are spaced to form a channel therebetween, (b) and said channel is adapted to receive said handle therein to provide the said confinement of said caddy between said bag and said handle.

7. The vacuum cleaner of claim 6 wherein said bag, when expanded, comprises means to biasingly press said caddy toward said handle.

* * * * *